US007970493B2

(12) United States Patent
Kim et al.

(10) Patent No.: US 7,970,493 B2
(45) Date of Patent: Jun. 28, 2011

(54) MANAGEMENT SHIP AND WORKING ROBOTS IN WATERS BASED ON WIRELESS NETWORK AND WORKING ROBOT CONTROL METHOD THEREOF

(75) Inventors: Bup-Joong Kim, Daejon (KR); Woo-Young Choi, Daejon (KR); Byung-Jun Ahn, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 943 days.

(21) Appl. No.: 11/904,459

(22) Filed: Sep. 27, 2007

(65) Prior Publication Data

US 2008/0082210 A1 Apr. 3, 2008

(30) Foreign Application Priority Data

Sep. 29, 2006 (KR) ..... 10-2006-0095565

(51) Int. Cl.
*G06F 19/00* (2011.01)
*G05B 19/18* (2006.01)
*G05B 15/02* (2006.01)

(52) U.S. Cl. ..... 700/255; 700/245; 700/3; 700/9; 700/23

(58) Field of Classification Search ..... None
See application file for complete search history.

(56) References Cited

U.S. PATENT DOCUMENTS 6,221,256 B1 4/2001 Kimura
6,374,155 B1 4/2002 Wallach et al.
6,408,226 B1 6/2002 Byrne et al.
2003/0105534 A1* 6/2003 Hara et al. ..... 700/2
2003/0176947 A1* 9/2003 Estkowski ..... 700/245
2004/0030451 A1* 2/2004 Solomon ..... 700/245
2004/0030570 A1* 2/2004 Solomon ..... 705/1
2007/0070808 A1* 3/2007 Ray et al. ..... 367/15
2009/0232605 A1* 9/2009 Breivik ..... 405/203
2009/0324338 A1* 12/2009 Thompson et al. ..... 405/158
2010/0157727 A1* 6/2010 Woodard et al. ..... 367/15

FOREIGN PATENT DOCUMENTS

JP 5-233059 9/1993

(Continued)

OTHER PUBLICATIONS

JPO Translation for JP 2001-308766.*

*Primary Examiner* — Khoi Tran
*Assistant Examiner* — Ian Jen
(74) *Attorney, Agent, or Firm* — Blakely Sokoloff Taylor & Zafman

(57) ABSTRACT

Provided are a management ship and working robots in waters based on a wireless network and a method for controlling working robots thereof. The robot-ship group includes: a signal strength measuring unit for measuring strengths of pre-defined signals; and a working robot control unit for determining which of the first mother ship and the second mother ship the working robot is to communicate with according to a comparison result of the signal strength, and controlling the working robots to perform the work according to a set-up route, wherein the first mother ship includes: a working robot preparing unit for performing a preparation work required before and after the working robots perform the work; and a mother ship control unit for transmitting the pre-defined signal to the working robot and communicating data with the working robot.

12 Claims, 5 Drawing Sheets

FOREIGN PATENT DOCUMENTS

| | | |
|---|---|---|
| JP | 2001-308766 | 11/2001 |
| JP | 2002-178283 | 6/2002 |
| KR | 1998-074453 | 11/1998 |
| KR | 2000-0056818 | 9/2000 |
| KR | 10-2004-0061903 | 7/2004 |
| KR | 10-2004-0086980 | 10/2004 |
| KR | 10-2006-0061945 | 6/2006 |
| WO | WO 96/25726 | 8/1996 |

* cited by examiner

MANAGEMENT SHIP AND WORKING ROBOTS IN WATERS BASED ON WIRELESS NETWORK AND WORKING ROBOT CONTROL METHOD THEREOF

CROSS-REFERENCES TO RELATED APPLICATIONS

The present invention claims priority of Korean Patent Application No. 10-2006-0095565, filed on Sep. 29, 2006, which is incorporated herein by reference.

BACKGROUND OF THE INVENTION

1. Field of the Invention

The present invention relates to a management ship and working robots in waters based on a wireless network and a method for controlling working robots thereof; and, more particularly, to a management ship and working robots in waters based on a wireless network for performing work on the sea or river through a wireless network formed by a mother ship, overlapping a communication region between mother ships, and extending a work region of the working robots, and a method for controlling working robots thereof.

This work was supported by the Information Technology (IT) research and development program of the Korean Ministry of Information and Communication (MIC) and/or the Korean Institute for Information Technology Advancement (IITA) [2005-S101-02, "Multimedia QoS Routing Technology Development"].

2. Description of Related Art

There are diverse ship groups for executing an object such as removal of oil, red tide, and dangerous articles, detecting a school of fish and jellyfish and their migratory route, inspection and detection of specific objects, and a special military work.

The ship group performs a work proper to a work purpose by mounting different kinds of devices or applying different kinds of methods according to the kinds of the work, work location, and a work environment.

For example, when oil is removed, a method of setting up an oil fence in a contaminated region, purifying contaminated water, and sending the purified water outside the oil fence, or a method that an oil separating/absorbing ship goes into the contaminated region and separates oil from the water is usually used.

Among the methods for removing red tide are a method putting yellow earth into the red tide, a method of spraying chemicals, an ultrasonic wave processing method, and an ozone processing method.

Continuous observation and data analysis are required through a relatively wide region in inspecting and detecting of a specific object. A detecting method by a satellite or a device fixed in a specific location is mainly used.

An automated manless device is required due to dangerousness and specialty of the work in the special military work such as removal of dangerous articles. Devices individually prepared according to a kind of the work are insufficient.

Accordingly, designing/operating/maintaining a conventional ship group for works on the sea and river is expensive and objects of the work are ultimately limited. For example, the ship group for the conventional work on the sea and river is not appropriate in cases that it is difficult to input man power and facilities due to bad weather or rainstorm, that operation of manned devices are limited due to dangerousness and specialty of the work, that diverse works are simultaneously performed in a small region, and that a specific object or a specific material is traced and detected in a broad region.

Also, there is a trouble that the typical ship group for work on the sea and river should use other kinds of ships or facilities according to the purpose of the work.

There is a method that the typical ship group for the work on the sea and river communicates with working robots through a repeater. Since the number of working robots allocated by the repeater is limited, it is difficult to adopt the method for a case when a plurality of working robots are required, such as removal of oil or red tide.

Therefore, the ship group needs to be free from the work region on the sea and river and overcome difficulty and specialty of the work environment.

It is also required that the ship group for a conventional work on the sea and river is variable according to a kind of work and situations, and flexibly and systematically perform the work such that diverse works are simultaneously performed within a short time.

SUMMARY OF THE INVENTION

An embodiment of the present invention is directed to providing a management ship and working robots in waters based on a wireless network for performing work on the sea or river by performing a work in a wireless network formed by a mother ship, overlapping a communication region between mother ships, and extending a work region of the working robots, and a method for controlling working robots.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a robot-ship group for executing a work operation on sea and river, the robot-ship group including, a first mother ship for having at least one working robots, and a second mother ship whose communication region is overlapped with a communication region of the first mother ship, the robot-ship group including: a signal strength measuring unit for measuring strengths of pre-defined signals transmitted from the first mother ship and the second mother ship; and a working robot control unit for determining which of the first mother ship and the second mother ship the working robot is to communicate with according to a comparison result of the signal strength measured in the signal strength measuring unit, and controlling the working robots to perform the work according to a set-up route, wherein the first mother ship includes: a working robot preparing unit for performing a preparation work required before and after the working robots perform the work; and a mother ship control unit for transmitting the pre-defined signal to working robot left from the working robot preparing unit and communicating data with the working robot through the authenticated second mother ship upon a communication end request of the working robot.

In accordance with another aspect of the present invention, there is provided a method for controlling working robots for a work on sea and river through a wireless network formed by a first mother ship having at least one working robot for work on the sea or river and a wireless network formed by a second mother ship whose communication region is overlapped with the communication region of the first mother ship, the method including the steps of: a) measuring strengths of pre-defined signals transmitted from the first mother ship and the second mother ship; b) comparing strength of the signals measured in the step a), and determining which of the first mother ship and the second mother ship the working robot is to communicate with; and c) performing a desired work according to a route setup by performing data communication with a determined mother ship.

DESCRIPTION OF SPECIFIC EMBODIMENTS

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on a related art may obscure the points of the present invention, the detailed description will not be provided herein. The preferred embodiments of the present invention will be described in detail hereinafter with reference to the attached drawings.

Figure 1:
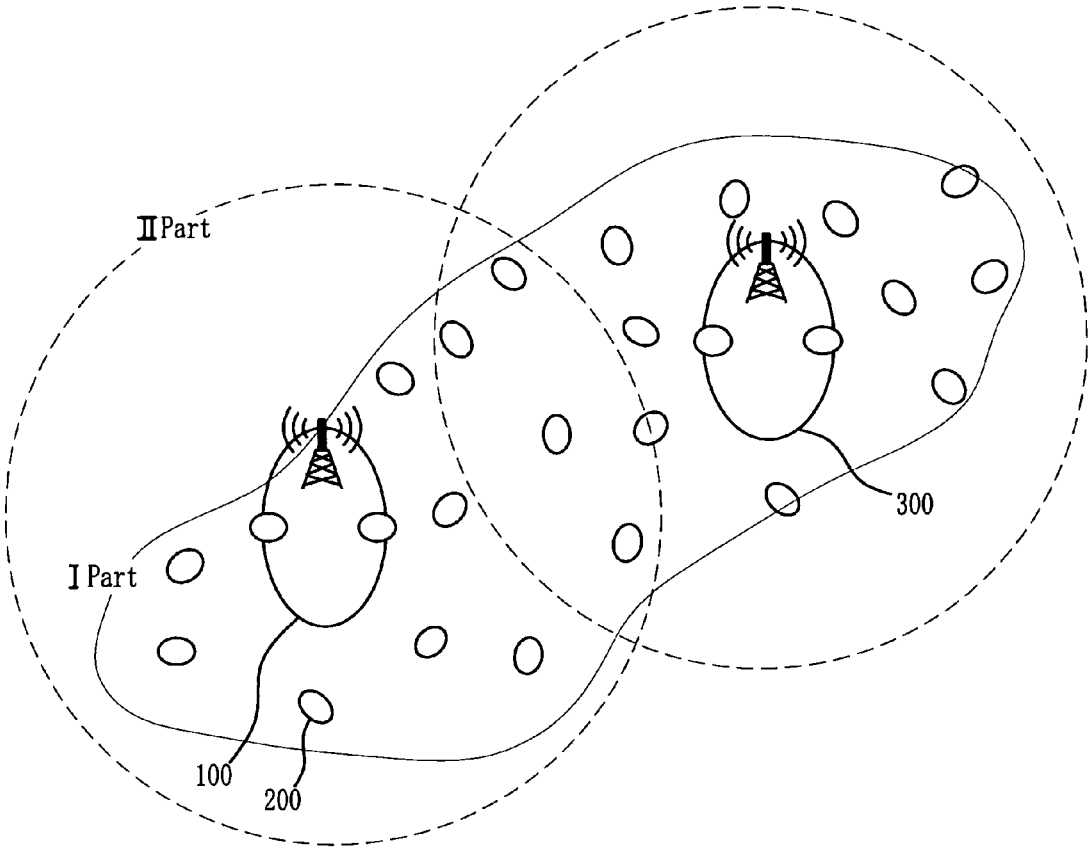
FIG. 1 shows a management ship and working robots on the sea and river based on a wireless network in accordance with an embodiment of the present invention.

FIG. 1 shows a management ship and working robots on the sea and river based on a wireless network in accordance with an embodiment of the present invention.

Referring to FIG. 1, the management ship may be referred to as a mother ship 100 and the working robots 200. Herein, the management ship and working robots according to the present invention can simultaneously perform at least one work on the sea and river. A case of removing oil from a I part on waters will be described as an example. A ship group includes one mother ship 100 and at least one working robot 200. The mother ship 100 and the working robots 200 execute a work operation by communicating data through a wireless network of a || part. The I part shows a region contaminated with the oil. The || part shows a virtual oil fence region which encompasses a region of an actual oil fence installed to prevent the oil from spreading in the I part and in which a wireless network is formed.

The mother ship 100 builds the wireless network of the || part to communicate with the working robots 200 and transmits/receives data with the robots 200 that freely move and work through a wireless communication channel. In short, the mother ship 100 works as an access point.

The mother ship 100 is located in a region where the mother ship 100 can communicate with a neighboring mother ship 300 and creates an electromagnetic wave overlapping region with the neighboring mother ship 300. Accordingly, the mother ship 100 extends a work region so that the working robots 200 controlled by the mother ship 100 can work on the wireless network formed by the neighboring mother ship 300. That is, the mother ship 100 can perform data communication with the working robots 200 to work in the region of the wireless network formed by the neighboring mother ship 300 by communicating with the neighboring mother ship 300.

The neighboring mother ship 300 performs data routing between the mother ship 100 and the working robots 200.

Since the mother ship 100 includes a gate that at least one working robot 200 can go in and out, a plurality of working robots 200 can simultaneously make a homeward voyage or sail from a port.

The mother ship 100 receives state information and request data from the working robots 200, and transmits data for controlling a work location, changing a work purpose, upgrading the functions of the working robots 200. Also, the mother ship 100 charges the working robots 200, removes foreign substances flowing into of the working robots 200, charges a substance flowing out of the working robots 200, repairs a problem of the working robots 200, and shifts the working robots 200.

The working robots 200 can perform a desired work in a watery environment such as sea and river. For example, the working robots 200 remove oil in the waters by absorbing a contaminative material or oil, or discharging a purifying material, i.e., an oil decontaminant.

The working robots 200 transmit/receive data to/from the mother ship 100 through the communication channel of the wireless network formed by the mother ship 100. When the working robots 200 move from the mother ship 100 to the neighboring mother ship 300, the working robots 200 notify the movement to the mother ship 100 and the neighboring mother ship 300. Accordingly, the working robots 200 can continuously perform data communication with the mother ship 100 by using a routing function that the neighboring mother ship 300 relays data.

The working robots 200 set up a route under the control of the mother ship 100 or on their own within a work region. For example, when oil is removed by the working robots 200, the working robots 200 analyze collected information, determine a direction and speed to move, and performs the work again. Also, when a working robot 200 monitors and detects a specific object, the mother ship 100 determines the motion pattern and the working robot 200 performs the work in a specific region assigned thereto.

Figure 2:
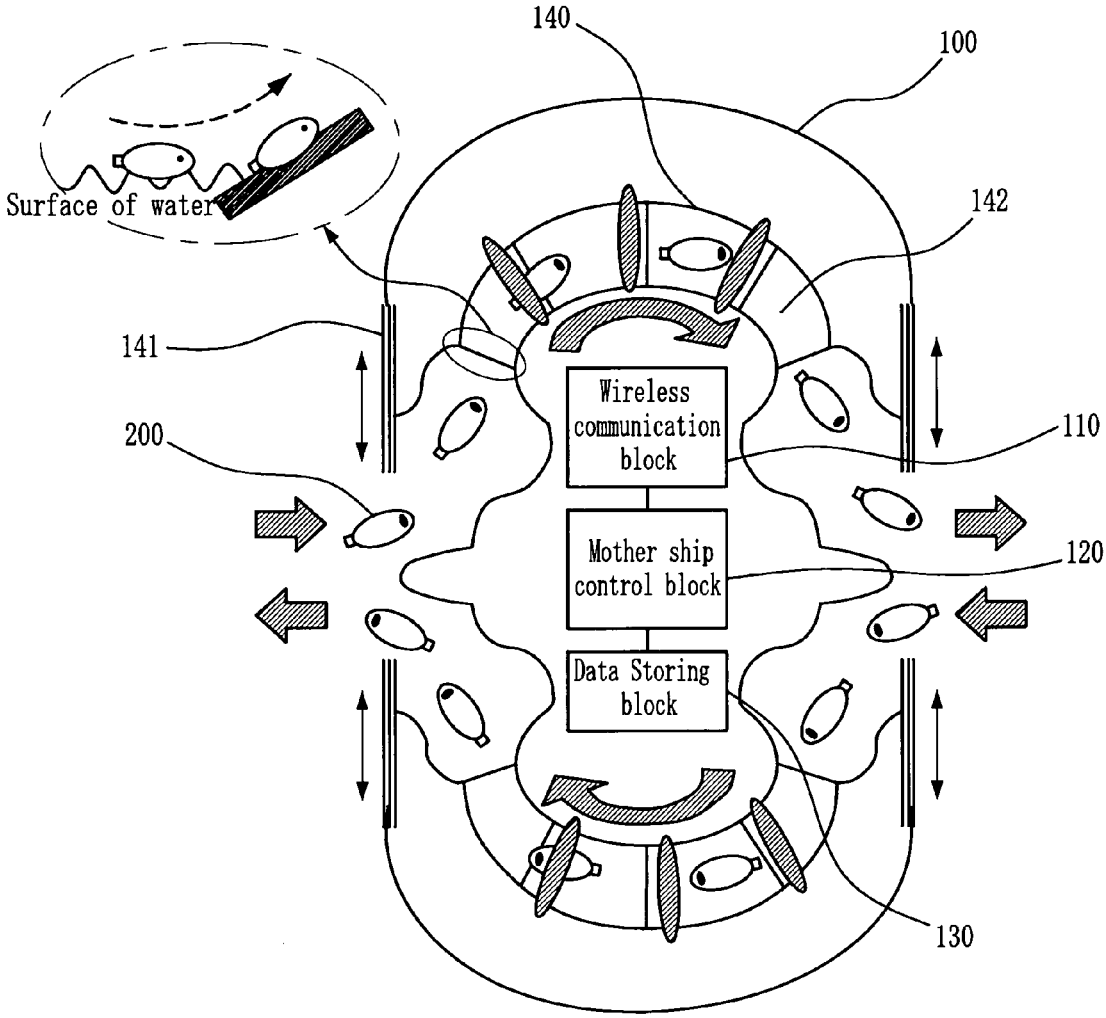
FIG. 2 shows the mother ship in accordance with an embodiment of the present invention.

FIG. 2 shows the mother ship 100 in accordance with an embodiment of the present invention.

Referring to FIG. 2, the mother ship 100 includes a wireless communication block 110, a mother ship control block 120, a data storing block 130, and a working robot preparing block 140.

The wireless communication block 110 communicates with the working robots 200 or the neighboring mother ship 300. It is preferred that the wireless communication block 110 communicates with the working robots 200 or the neighboring mother ship 300 based on an Internet protocol version 4 (IPv4) or an IPv6.

Since the wireless communication block 110 performs data communication with the working robots 200 performing a station function when the mother ship 100 works as an access point, the wireless communication block 110 is created by the mother ship control block 120 and performs data communication based on an Internet Protocol (IP) address allocated according to the working robots 200.

When the working robots of the neighboring mother ship 300 work within the communication region of the mother ship 100, the wireless communication block 110 relays data communicated between the neighboring mother ship 300 and the working robots.

The mother ship control block 120 controls the wireless communication block 110, the data storing block 130, and the working robot preparing block 140.

The mother ship control block 120 performs an authentication procedure for communication with the working robots 200 or the neighboring mother ship 300. That is, the mother ship control block 120 performs data conversion based on an encoding code pre-allocated to the working robots 200 or the neighboring mother ship 300, and the data are transmitted. The converted data, which are transmitted from the working robots 200 or the neighboring mother ship 300, are checked based on the pre-allocated decoding code. Subsequently, the mother ship control block 120 checks the origin of the data by checking identification (ID) pre-allocated to the working robots 200 or the neighboring mother ship 300 included in the data, and checks state information included in the data.

The mother ship control block 120 performs data communication with the working robots 200 or the neighboring mother ship 300 through the wireless communication block 110.

The mother ship control block 120 performs data communication with the authenticated working robots 200 by allocating ID, an encoding code, a decoding code, an IP address to the working robots 200. In particular, the mother ship control block 120 creates the IP address by combining a base address of the mother ship 100 and the ID of the working robots 200 and converting the entire or a part of the combination into an encoding code.

The mother ship control block 120 performs data communication with the neighboring mother ship 300 by storing a decoding code, which is in common with the neighboring mother ship 300. That is, the mother ship control block 120 can check out information obtained by transforming the entire or part of a data number and ID of the neighboring mother ship 300 transmitted from the neighboring mother ship 300 into an encoding code based on the decoding code.

With the decoding code, the mother ship control block 120 goes through the authentication procedure of the neighboring mother ship 300 and make the neighboring mother ship 300 safely communicate with the working robots 200.

The mother ship control block 120 controls the working robot preparing block 140 to collect state information of the working robots 200, transmit/receive data, collect and array the working robots 200, charge the working robots 200 with power, remove a foreign substance flowing into the working robots 200 and charge a substance flowing out of the working robots.

The data storing block 130 stores the ID, the encoding code, the decoding code, and the IP address allocated according to the working robots 200. The data storing block 130 stores the ID, the data number, and the decoding code allocated to the neighboring mother ship 300.

The working robot preparing block 140 includes at least one gate 141 for putting the working robots 200 onto the sea or river, and a circulation passage 142 where the working robots 200 enters the mother ship 100 on surface of water.

The working robot preparing block 140 performs preparation required for the work of the working robots 200. That is, the working robot preparing block 140 performs a circulation parallel work such as state information collection of the working robots 200, data transmission/reception, collection and array of the working robots 200, power supply to the working robots 200, removal of an inflow and charging of an outflow in the circulation passage 142. Subsequently, the working robot preparing block 140 sends the working robots 200 passing the circulation passage 142 to the sea or river through the gate.

Figure 3:
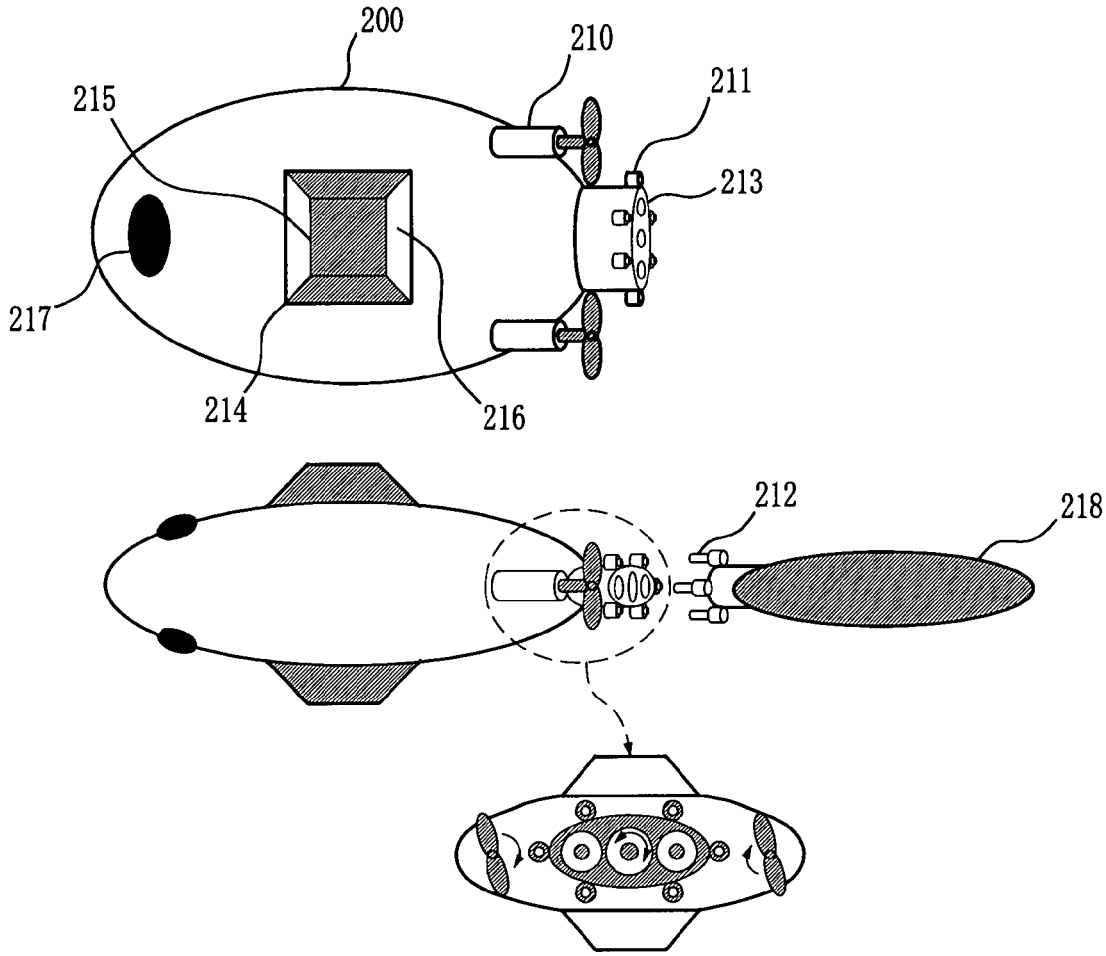
FIG. 3 shows an external configuration of the working robots 200 in accordance with an embodiment of the present invention.

FIG. 3 shows an external configuration of the working robots 200 in accordance with an embodiment of the present invention.

Referring to FIG. 3, in the outside of the working robots 200 according to the present invention, there are a driving unit 210, supplementary device connecting units 211 and 212, a power transmitting unit 213, an inflow/outflow unit 214, an inlet 215, an outlet 216, an image/sensing unit 217, and a supplementary device 218.

The working robot 200 according to the present invention is vertically symmetrical. Although the working robot 200 is turned over by wave or collision, the working robot 200 can perform a work continuously and move by using the driving unit 210 in the rear part.

The working robots 200 may attach the supplementary device 218 required for a specific work. Herein, the working robots 200 are mechanically connected with the supplementary device 218 through the supplementary device connecting units 211 and 212, and transmit/receive data to/from the supplementary device 218. The working robots 200 transmit required power to the supplementary device 218 through at least one power transmitting unit 213.

The working robots 200 acquire a still picture and a moving picture by detecting a route of a specific object or a specific material through the image/sensing unit 217.

The working robot 200 takes a specific material from the river through the inlet 215, or puts out a specific material through the outlet 216 in the inflow/outflow unit 214.

Figure 4A:
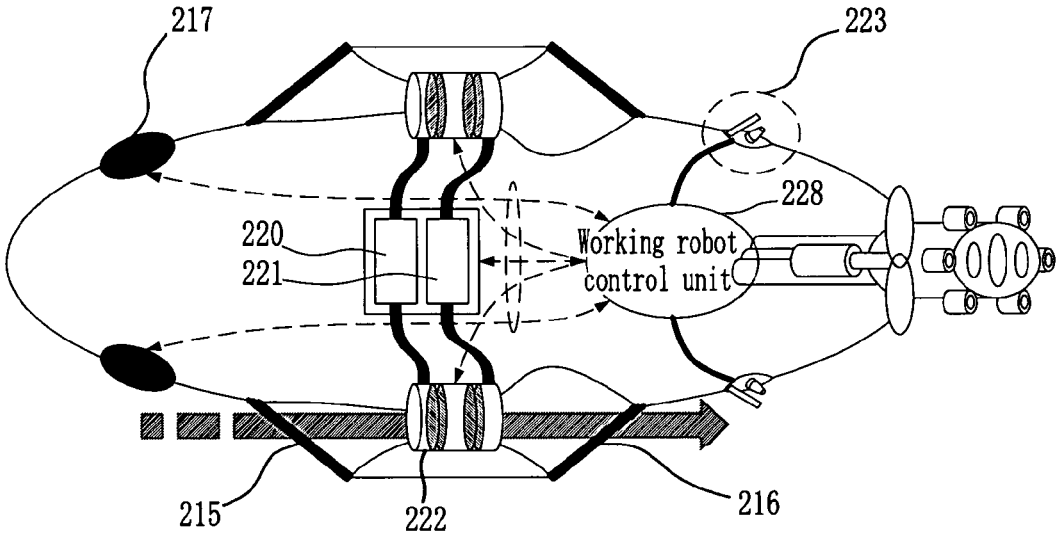
FIG. 4A shows an internal configuration of the working robot in accordance with an embodiment of the present invention.
Figure 4B:
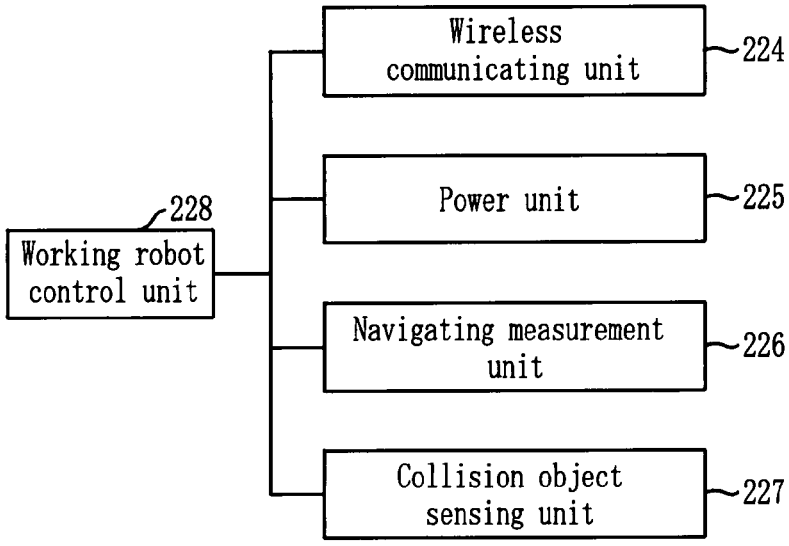
FIG. 4B shows internal constituent elements of the working robot, which is not shown in FIG. 4A, in accordance with an embodiment of the present invention.

FIG. 4A shows an internal configuration of the working robot 200 in accordance with an embodiment of the present invention. FIG. 4B shows internal constituent elements of the working robot 200, which is not shown in FIG. 4A, in accordance with an embodiment of the present invention.

Referring to FIGS. 4A and 4B, in the inside of the working robots 200 according to the present invention, there are an inflow substance storing unit 220, an outflow substance storing unit 221, an inflow/outflow processing unit 222, a data transmitting unit 223, a wireless communicating unit 224, a power unit 225, a navigation measurement unit 226, a collision object sensing unit 227, and a working robot control unit 228.

The inflow substance storing unit 220 stores a specific material extracted from the sea or river and the outflow substance storing unit 221 stores a specific material to be sprayed onto the sea or river. The inflow substance storing unit 220 and the outflow substance storing unit 221 has a sensor for sensing the quantity of a substance.

The inflow/outflow processing unit 222 includes a partition for preventing substances from mixing when the substances flow in and out, and a filter for preventing an external substance from flowing in when the substances flow in and out. The inflow/outflow processing unit 222 is connected with the inflow substance storing unit 220 and the outflow substance storing unit 221.

The data transmitting unit 223 is connected with the working robot control unit 228. When working robots 200 pass through the working robot preparing block 140 of the mother ship 100, the data transmitting unit 223 provides state information and the collected data of the working robots 200 to the mother ship 100. Herein, the data transmitting unit 223 works as an auxiliary communication channel and makes the mother ship 100 upgrade data and input work indication command to the working robots 200.

The wireless communicating unit 224 is connected with the working robot control unit 228 and provides state information of the working robots 200 and the collected data to the mother ship 100 through a wireless communication channel.

The power unit 225 supplies power to the working robots 200 and is charged in the working robot preparing block 140 of the mother ship 100.

The navigation measurement unit 226 includes a Global Positioning System (GPS) receiver for measuring a location of the working robots 200 and a speed/acceleration sensor for measuring the speed and acceleration of the working robots 200. The navigation measurement unit 226 provides measurement information for the working robots 200 to move to a location of predetermined coordinates within a predetermined time to the working robot control unit 228.

The collision object sensing unit 227 detects a collision object colliding against the working robots 200 while the working robots 200 are in the mobile state or still state based on an ultrasonic wave, a sound wave, a radio wave, radiation, and infrared rays. The collision object sensing unit 227 changes the location of the working robots 200 by providing the detected collision object information to the working robot control unit 228 before collision.

The working robot control unit 228 monitors the working robots 200 by electrically and mechanically controlling each constituent element in the inside and outside of the working robots 200 and collecting diverse state information in the inside and outside of the working robots 200.

The working robot control unit 228 performs data communication with the mother ship 100 through the data transmitting unit 223 or the wireless communicating unit 224. Herein, the working robot control unit 228 limits a communication region of the mother ship 100 as a work region of the working robots 200.

The working robot control unit 228 can limit the communication region with the mother ship 100 as the work region of the working robots 200 by maintaining a threshold of a predefined signal strength which is transmitted from the mother ship 100 through the wireless communicating unit 224. Also, the working robot control unit 228 transmits/receives a message, e.g., a heartbeat, including location information of the mother ship 100 at a regular interval within the work region. Accordingly, although the working robot control unit 228 is temporarily out of the work region and the signal transmitted from the mother ship 100 is not sensed, the working robot control unit 228 can change a direction toward the mother ship 100 based on the location information of the mother ship 100 and enters the communication region of the mother ship 100 again. As described above, the working robot control unit 228 performs the work by limiting a range within a predetermined communication distance from the mother ship 100 as a work region.

The working robot control unit 228 performs the work by moving into the communication region formed by the neighboring mother ship 300 when communication regions of the mother ship 100 and the neighboring mother ship 300 are overlapped. The mother ship 100 and the neighboring mother ship 300 can determine mutual safety by maintaining a communication distance to have a section where signals are received from the both, and performing a mutual authentication procedure in advance.

When the working robot control unit 228 moves in a region where the communication regions of the mother ship 100 and the neighboring mother ship 300 are overlapped, the working robot control unit 228 measures and compares the strength of signals which are transmitted from the mother ship 100 and the neighboring mother ship 300 in a signal sensing unit (not shown in FIG. 4A). When the signal strength transmitted from the neighboring mother ship 300 is stronger, the working robot control unit 228 determines to change the communication region from the wireless network formed by the mother ship 100 into the wireless network formed by the neighboring mother ship 300. Accordingly, when the signal strength transmitted from the mother ship 100 and the neighboring mother ship 300 rapidly changes, the working robot control unit 228 may frequently change a mother ship to communicate with. To prevent the frequent change of the mother ship and determine whether to change the wireless network formed by the mother ship into the wireless network formed by the neighboring mother ship 300, it is preferred that the working robot control unit 228 compares the signal strength of the mother ships 100 and 300 by calculating an average value of the signal strengths at a predetermined time, or determines whether the signal strength of the mother ships 100 and 300 are larger than a predetermined threshold.

Subsequently, in order to change a communicating mother ship from the mother ship 100 into the neighboring mother ship 300, the working robot control unit 228 requests the mother ship 100 for sagely showing whether the neighboring mother ship 300 has gone through the authentication procedure, communication address information, and base address information.

When information requested by the mother ship 100 is received, the working robot control unit 228 notifies the mother ship 100 that the working robots have moved into the communication region of the movement of the neighboring mother ship 300. Herein, the mother ship 100 notifies an IP address, ID, a decoding code, authentication data, the kind of work, work history, and log data of the working robots 200 to the neighboring mother ship 300.

The working robot control unit 228 requests the neighboring mother ship 300 for a temporary communication address and the change of a mother ship and receives data requested by the neighboring mother ship 300. The working robot control unit 228 transmits/receives data with the neighboring mother ship 300 based on Address Resolution Protocol (ARP) or router solicitation algorithm.

Subsequently, the working robot control unit 228 ends communication with the mother ship 100 and communicates with the neighboring mother ship 300 based on the temporary communication address transmitted from the neighboring mother ship 300.

The working robot control unit 228 analyzes and processes the data inputted into the image/sensing unit 217, and detects a route of a specific material or a specific object. That is, the working robot control unit 228 analyzes distribution/speed/direction of a specific material or a specific object based on the data inputted from the image/sensing unit 217. For example, the working robot control unit 228 figures out distribution/speed/direction of oil by analyzing image information on image difference between see water and oil collected by the image/sensing unit 217 and sense information on oil components. Accordingly, the working robot control unit 228 performs a work while moving within the work region of the mother ship based on the distribution/speed/direction of the oil. Additionally, it is preferred that the working robot control unit 228 changes the location of working robot 200 according to individual oil flow and distribution under the control of the mother ship 100.

Also, the working robot control unit 228 sets up a route by control of the mother ship 100. For example, the working robot control unit 228 performs the work while moving according to a designated moving pattern such as "moving along a circle having a radius A" and "moving along a straight line" from the mother ship 100 in detecting a specific object.

The working robot control unit 228 collects state information from the supplementary device 218 through the supplementary device connecting units 211 and 212. The working robot control unit 228 checks a sensor in the inflow substance storing unit 220 and the outflow substance storing unit 221.

The working robot control unit 228 controls power to be transmitted to the driving unit 210 and the power transmitting unit 213 such that the working robots 200 can move or change the direction. The working robot control unit 228 moves along with a specific material or a specific object based on the image/sense information provided from the image/sensing unit 217 and moves to a location of predetermined coordinates based on the measurement information provided from the navigation measurement unit 226. As described above, the working robot control unit 228 can set up a route and move according to its own determination. Also, the working robot control unit 228 can set up a moving pattern determined under the control of the mother ship 100 as a route and move.

The working robot control unit 228 senses a collision object in advance while moving or stopping based on the sense information transmitted from the collision object sensing unit 227 and changes direction or location to prevent collision.

The working robot control unit 228 performs control to open/close the inlet 215 and the outlet 216 for inflow/outflow of a specific material on the sea and river according to characteristics of the work. The working robot control unit 228 controls the inflow/outflow processing unit 222 for sending a specific material to the inflow substance storing unit 220 by detecting the specific material flown in through the inlet 215 or flowing out a specific material flown out through the outlet 216 from the outflow substance storing unit 221.

The working robot control unit 228 monitors a power state by using a sensor installed in the power unit 225 and can check time for charging power.

Figure 5:
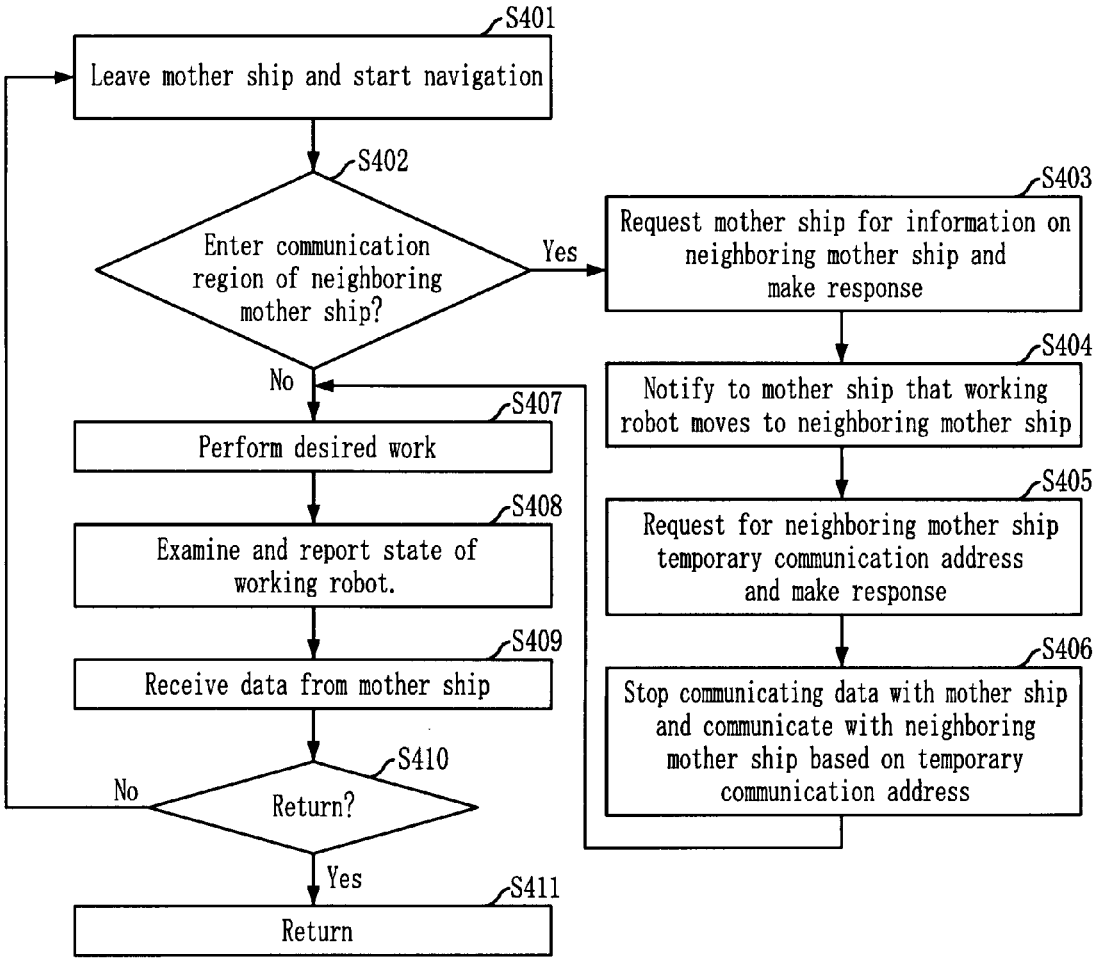
FIG. 5 is a flowchart describing a method for controlling the working robot in accordance with an embodiment of the present invention.

FIG. 5 is a flowchart describing a method for controlling the working robots 200 in accordance with an embodiment of the present invention.

Referring to FIG. 5, the working robot 200 according to the present invention leaves a mother ship and starts navigation at step S401. The working robot 200 traces a specific material or a specific object, or traces predetermined coordinates. Also, the working robot 200 senses and avoids collision with the specific material or the specific object.

Subsequently, the working robot 200 measures strength of pre-defined signals transmitted from the mother ship 100 and the neighboring mother ship 300 and checks whether to change the communication region at step S402. When the signal transmitted from the neighboring mother ship 300 is stronger than the signal transmitted from the mother ship 100, the working robots 200 determines that the communication region is moved to the neighboring mother ship 300.

The working robot 200 requests information on the neighboring mother ship 300 to the mother ship 100 and the mother ship 100 responds to it at step S403. The working robot 200 requests the mother ship 100 for safety, communication address information, and base address information of the neighboring mother ship 300.

When the working robot 200 notifies to the mother ship 100 that the working robot 200 moves to the neighboring mother ship 100, the mother ship 100 notifies an IP address, an ID, and a decoding code of the working robot 200 to the neighboring mother ship 300 at step S404.

The working robot 200 requests the neighboring mother ship 300 for a temporary communication address and receives a response at step S405. The working robot 200 stops data communication with the mother ship 100 and communicates with the neighboring mother ship 300 based on the temporary communication address at step S406. The neighboring mother ship 300 relays the data communication between the mother ship 100 and the working robot 200.

While the working robot 200 communicates with the mother ship 100 without moving to the communication region of the neighboring mother ship 300 or communicates with the neighboring mother ship 300 after moving to the communication region of the neighboring mother ship 300, the working robot 200 performs the work at step S407.

Simultaneously, the working robot 200 examines a state of the working robot 200 itself and reports the state to the mother ship 100 through relay of the mother ship 100 or the neighboring mother ship 300 at step S408. The working robot 200 examines the state of the working robot 200 such as states of a filter, disorder, outflow/inflow on the sea and river, a work process, and communication and check of location.

The working robot 200 receives data directly from the mother ship 100 or receives data from the mother ship 100 through the relaying of the neighboring mother ship 300 at step S409. That is, the working robot 200 receives a command from the mother ship 100 on checking the work, identifying an extracted material, positioning the location of the mother ship, and checking a return command.

When the working robot 200 receives data such as completion of the work, occurrence of disorder and a return command at step S410 during the work procedure, the working robot 200 returns to the mother ship 100 at step S411. When a return condition is not satisfied, the working robot 200 determines to work and move, and a logic flow goes to the step S401.

The procedures described above are described for the sake of convenience in explanation. However, all procedures may be changed according to the kind of information or the kind of work, or may be processed in parallel.

The present invention can overcome difficulty and specialty of a work environment by forming a ship group including a mother ship and working robots based on a wireless network on the sea and river.

The present invention can flexibly and systematically perform a work operation by flexibly varying the ship group according to the kind of work and a work environment and simultaneously performing diverse works within a short time.

Also, the present invention can acquire a bandwidth for communication with a plurality of working robots in the mother ship in comparison with a method of communicating with the working robots through a repeater.

As described above, the technology of the present invention can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to the specific embodiments, it will be apparent to those skilled in the art that various changes and modifications may be made without departing from the spirit and scope of the invention as defined in the following claims.

What is claimed is:

1. A robot-ship group for executing a work operation on sea and river, the robot-ship group comprising:

at least one working robot;

a first mother ship having the at least one working robot; and a second mother ship whose communication region is overlapped with a communication region of the first mother ship, wherein the at least one working robot includes:

a signal strength measurement means for measuring strength of pre-defined signals transmitted from the first mother ship and the second mother ship; and a working robot control means for determining which of the first mother ship and the second mother ship the at least one working robot is to communicate with according to a comparison result of the signal strength measured in the signal strength measurement means, and controlling the at least one working robot to perform the work according to a set-up route, and wherein the first mother ship includes:

a working robot preparing unit for performing a preparation work required before and after the at least one working robot performs the work; and a mother ship control unit for transmitting a pre-defined signal to the at least one working robot after said performing by the working robot preparing unit, wherein the working robot control means calculates an average value of the signal strength measured by the signal strength measurement means at a predetermined time and determines which of the first mother ship and the second mother ship the at least one working robot is to communicate with.

2. The robot-ship group of claim 1, wherein the working robot further includes:

an image/sensing means for providing image/sense information to the working robot control means in order to set up a route according to a route of a specific material or a specific object; and a navigation measurement means for providing measurement information to the working robot control means in order to set up a route according to a command transmitted from the mother ship which is determined to perform communication with the working robots between the first mother ship and the second mother ship.

3. A robot-ship group for executing a work operation on sea and river, the robot-ship group comprising:

at least one working robot;

a first mother ship having the at least one working robot; and a second mother ship whose communication region is overlapped with a communication region of the first mother ship, wherein the at least one working robot includes:

a signal strength measurement means for measuring strength of pre-defined signals transmitted from the first mother ship and the second mother ship; and a working robot control means for determining which of the first mother ship and the second mother ship the at least one working robot is to communicate with according to a comparison result of the signal strength measured in the signal strength measurement means, and controlling at least one working robots robot perform the work according to a set-up route, and wherein the first mother ship includes:

a working robot preparing unit for performing a preparation work required before and after the at least one working robot performs the work; and a mother ship control unit for transmitting a pre-defined signal to the at least one working robot after said performing by the working robot preparing unit, wherein the working robot includes:

a collision object sensing means for sensing an object which may collide with the working robot in advance while the working robot is in motion or at a stand still, and wherein the working robot control means senses a collision object in advance based on the information transmitted from the collision object sensing means and prevents collision.

4. The robot-ship group of claim 3, wherein the working robot control means periodically checks whether the signal strength measured in the signal strength measurement means is the same or larger than a predetermined threshold, and determines which of the first mother ship and the second mother ship the at least one working robot is to communicate with.

5. The robot-ship group of claim 1, wherein the working robot control means determines which of the first mother ship and the second mother ship the at least one working robot is to communicate with and maintains the received pre-defined signal strength on the basis of threshold in order to have an optimal signal strength for communication with the mother ship.

6. The robot-ship group of claim 5, wherein although the at least one working robot is out of a communication region of the mother ship, the working robot control means changes a direction toward the mother ship based on location information of the mother ship included in the signals transmitted from the mother ship which is determined to communicate with the at least one working robot and reenters the communication region of the mother ship.

7. The robot-ship group of claim 1, wherein the mother ship control unit authenticates the at least one working robot and the second mother ship by using pre-allocated encoding/decoding codes.

8. A method for controlling working robots for a work on sea and river through a wireless network formed by a first mother ship having at least one working robot for work on the sea or river and a wireless network formed by a second mother ship whose communication region is overlapped with the communication region of the first mother ship, the method comprising the steps of:

a) measuring strength of pre-defined signals transmitted from the first mother ship and the second mother ship;

b) comparing strength of the signals measured in the step a), and determining which of the first mother ship and the second mother ship the working robot is to communicate with; and c) performing data communication with the determined mother ship and performing a work according to a set-up route, wherein the step c) includes the steps of:

c1) when the working robot is determined to communicate data with the second mother ship, requesting the first mother ship for information needed to communicate with the second mother ship;

c2) when the requested information is received from the first mother ship, notifying movement into the communication region of the second mother ship to the first mother ship and requesting the second mother ship for a temporary communication address; and c3) ending communication with the first mother ship upon the receipt of the temporary communication address and communicating with the second mother ship based on the temporary communication address.

9. The method of claim 8, wherein in the step c), the route is set up according to a route of a specific material or a specific object, or set up according to a command transmitted from the mother ship.

10. The method of claim 8, wherein in the step c), an object which is on the route and may collide with the working robot is sensed in advance, and location of the working robot is changed.

11. The robot-ship group of claim 1, wherein the mother ship control unit is also for communicating data with the at least one working robot through an authenticated second mother ship upon communication request of the working robot.

12. A method for controlling working robots for a work on sea and river through a wireless network formed by a first mother ship having at least one working robot for work on the sea or river and a wireless network formed by a second mother ship whose communication region is overlapped with the communication region of the first mother ship, the method comprising the steps of:

a) measuring strength of pre-defined signals transmitted from the first mother ship and the second mother ship at a predetermined time;

b) comparing strength of the signals measured in the step a), and determining which of the first mother ship and the second mother ship the working robot is to communicate with; and c) performing data communication with the determined mother ship and performing a work according to a set-up route.

* * * * *